US006102756A

United States Patent [19]

Michel et al.

[11] Patent Number: 6,102,756

[45] Date of Patent: Aug. 15, 2000

[54] TURNING-AID NOZZLE

[75] Inventors: Camille Michel, Ste-Foy, Canada; Alain Rhéault, Marion, Ill.

[73] Assignee: Bombardier Inc., Montreal, Canada

[21] Appl. No.: 09/204,465

[22] Filed: Dec. 3, 1998

[30] Foreign Application Priority Data

Dec. 3, 1997 [CA] Canada ..... 2223346

[51] Int. Cl.[7] ..... B63H 11/113

[52] U.S. Cl. ..... 440/42; 440/38

[58] Field of Search ..... 440/38, 40–42, 440/47; 244/52; 114/144 R, 151, 166

[56] References Cited

U.S. PATENT DOCUMENTS 3,413,950 12/1968 Gravenstreter ..... 440/42

*Primary Examiner*—Ed Swinehart

*Attorney, Agent, or Firm*—St. Onge Steward Johnston & Reens LLC

[57] ABSTRACT

A turning-aid nozzle mounted in the region of the outlet of a watercraft's propulsion system comprises a starboard inner surface and a port inner surface protruding radially inwardly from the nozzle in such a manner as to obstruct the flow of water from the watercraft's propulsion system. When turning to port, the starboard inner surface obstructs a portion of the water jet exiting the propulsion system, thereby producing an additional turning moment that aids the nozzle in turning to port. Similarly, when turning to starboard, the port inner surface obstructs a portion of the water jet exiting the propulsion system, thereby producing an additional turning moment that aids the nozzle in turning to starboard.

16 Claims, 3 Drawing Sheets

TURNING-AID NOZZLE

FIELD OF THE INVENTION

The invention relates to an improved steerable nozzle for water-jet propelled watercraft and, more particularly, to a turning-aid nozzle that allows the watercraft driver to steer the watercraft with minimal effort.

BACKGROUND OF THE INVENTION

A watercraft is a new recreational vehicle which has had a resounding commercial success during the last several years. It is understood that the word "watercraft" includes, but it is not confined to, personal watercraft, jet boat or similarly powered vehicles. Typically, a watercraft includes a hull having a tunnel in which the engine shaft and the pump of the watercraft are located. The pump is mounted in a pump housing having a water inlet and a water outlet. The watercraft is thus propelled by the water jet created by the pump. In order to increase the speed and acceleration of the watercraft, a venturi-orifice is mounted on the water outlet of the pump housing. The venturi-orifice constricts the flow of water, thereby accelerating the water jet.

The steering of the watercraft is accomplished by controlling the direction of the water jet. The mechanism used is a steering nozzle which is pivotally mounted on the venturi-orifice. This nozzle has a lever mounted on it which is connected to a cable. The cable will pull or push this lever when the operator turns the steering mechanism. For example, when the operator turns the steering handle towards the right (i.e. to starboard), the cable pulls the lever which, in turn, rotates the nozzle in the counterclockwise direction (as seen from above). In so doing, the nozzle directs the water jet at an angle with respect to the longitudinal axis of the venturi-orifice; the greater the angle, the sharper the turn. In prior art watercrafts, the effort required by the driver is significant in order to offset the natural tendency of the nozzle to stay in the longitudinal axis of the water jet. The more powerful the water jet pump is, the more force that is required on the cable to turn the watercraft.

For certain types of watercraft, the water jet is simply too powerful and the operator cannot steer the watercraft without a power steering mechanism. This mechanism usually includes a hydraulic cylinder supplying the force required to steer the watercraft. The addition of a power steering mechanism increases the cost, weight and complexity of the watercraft.

Thus, there is a need in the watercraft industry to provide a steering nozzle which facilitates steering of the watercraft without reverting to a costly, heavy and complex power steering system.

OBJECT AND STATEMENT OF THE INVENTION

It is thus an object of the present invention to provide an improved steering nozzle that facilitates steering of the watercraft.

It is another object of the present invention to provide a steering nozzle that is easily turned, especially at high speeds when the thrust of the water jet is difficult for the driver to overcome.

It is another object of the present invention to provide a steering nozzle that is cost-effective, simple, reliable and light.

It is another object of the present invention to provide a steering nozzle that does not involve hydraulic or pneumatic power steering.

As embodied and broadly described herein, the invention seeks to provide a turning-aid nozzle mounted in the region of the outlet of a watercraft propulsion system, said nozzle being moveable to any orientation between an extreme starboard orientation and an extreme port orientation, said nozzle being capable of directing the water jet egressing said propulsion system in order to steer said watercraft, said nozzle comprising:

(A) a steering linkage connected at one end to a steering mechanism, said steering linkage being connected at the other end to said nozzle such that a force exerted on the steering linkage causes the nozzle to rotate, thereby directing the water jet either to starboard or port;

(B) a starboard inner surface protruding radially inwardly from the inner wall of said nozzle such that during a turn to port the water jet egressing from the watercraft propulsion system impinges on said starboard inner surface, thereby creating an additional turning moment to port; and (C) a port inner surface protruding radially inwardly from the inner wall of said nozzle such that during a turn to starboard the water jet egressing from the watercraft propulsion system impinges on said port inner surface, thereby creating an additional turning moment to starboard;

whereby, when the nozzle is aligned parallel to the water jet egressing from the propulsion system, an insubstantial amount of water impinges upon said starboard and port inner surfaces.

When the driver turns the nozzle, the water jet exiting the venturi-orifice impinges upon the one of the inner surfaces, thereby creating a turning moment on the nozzle in the direction that the driver seeks to turn. Thus, the force required by the driver to turn the nozzle is diminished. This greatly facilitates steering of the watercraft, especially when the thrust of the water jet is strong. This turning-aid nozzle is, furthermore, light, reliable and easy to manufacture.

Preferably, the starboard inner surface is capable of producing a greater turning moment than said port inner surface in order to compensate for the direction of rotation of the watercraft's pump. A slight amount of asymmetry in the inner surfaces compensates for the natural tendency of the boat to pull toward one side due to the rotation of the pumps.

Preferably, said starboard inner surface and said port inner surface are substantially C-shaped. This allows the water jet to exit the venturi-orifice unobstructed by the inner surfaces when the nozzle is aligned in the neutral position. When the nozzle is turned, though, the C-shaped surface blocks a portion of the water-jet exiting the venturi-orifice, thereby creating an additional turning effect.

BRIEF DESCRIPTION OF THE DRAWINGS

A detailed description of the preferred embodiment of the invention is provided herein with reference to the following drawings, wherein.

Figure 1:
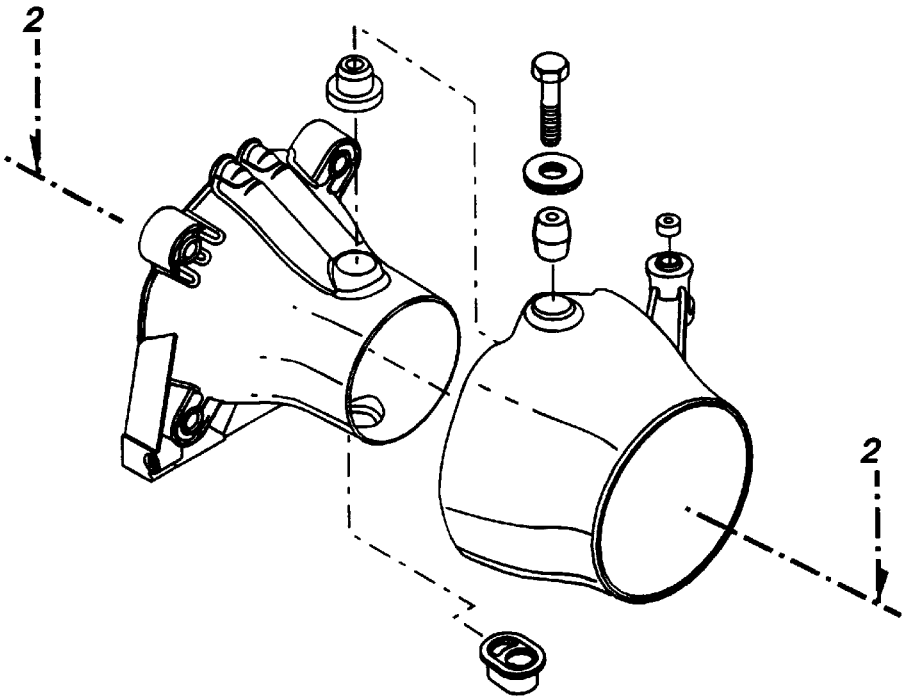
FIG. 1 is an isometric exploded view of a nozzle and venturi-orifice assembly.

In the drawings, the preferred embodiment of the invention is illustrated by way of example. It is to be expressly understood that the description and drawings are only for the purpose of illustration and as an aid to understanding, and are not intended as a definition of the limits of the invention.

DESCRIPTION OF THE PREFERRED EMBODIMENTS

FIG. 1 illustrates the assembly of a nozzle and venturi-orifice as found on many personal watercraft and jet-boat.

Figure 2:
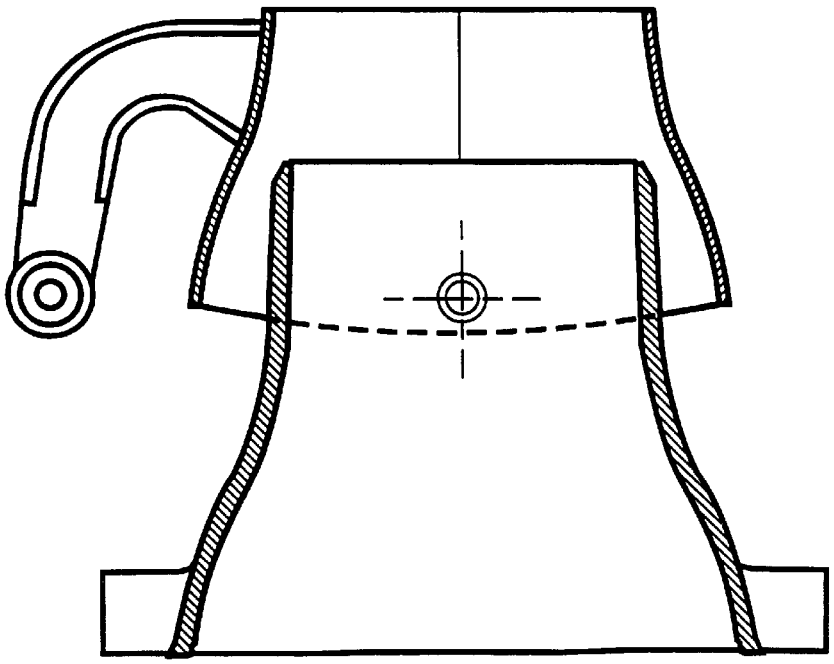
FIG. 2 is a sectional view of a prior art nozzle mounted on a venturi-orifice.

FIG. 2 illustrates a prior art nozzle. As illustrated, this prior art nozzle has a substantially bell shaped profile that accelerates the water so that a maximal thrust of the water jet is achieved. The prior art nozzle requires a substantial effort to steer because the thrust of the watercraft's propulsion system can be difficult to overcome by a human without the implementation of a power steering mechanism. The implementation of a power steering mechanism, however, increases the weight, cost and complexity of the watercraft.

Figure 3:
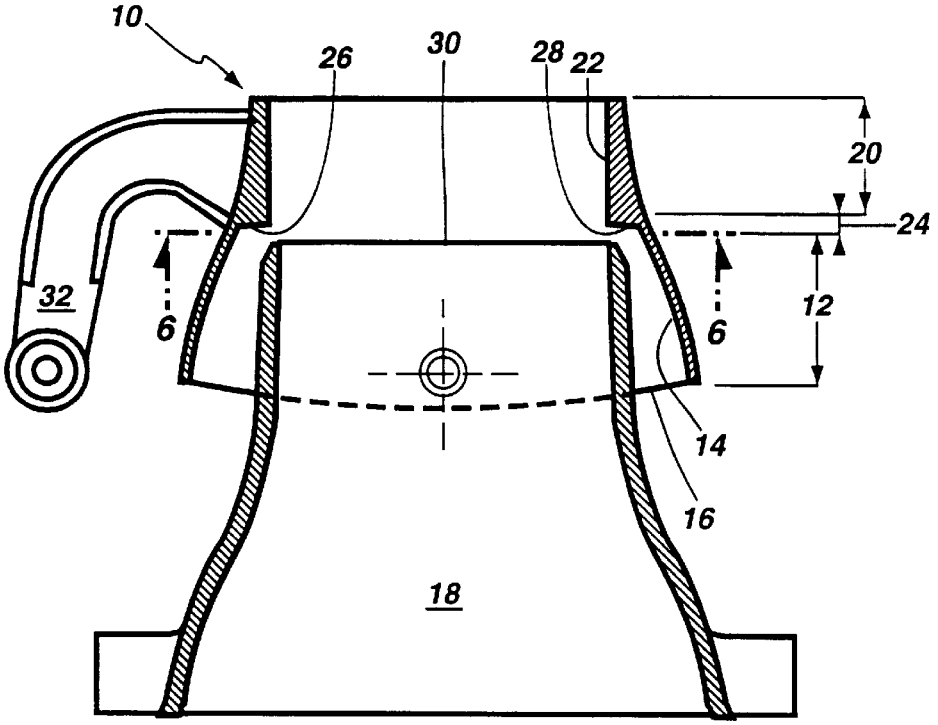
FIG. 3 is a sectional view of a turning-aid nozzle constructed in accordance with the invention, the nozzle being illustrated mounted on a venturi-orifice.
Figure 4:
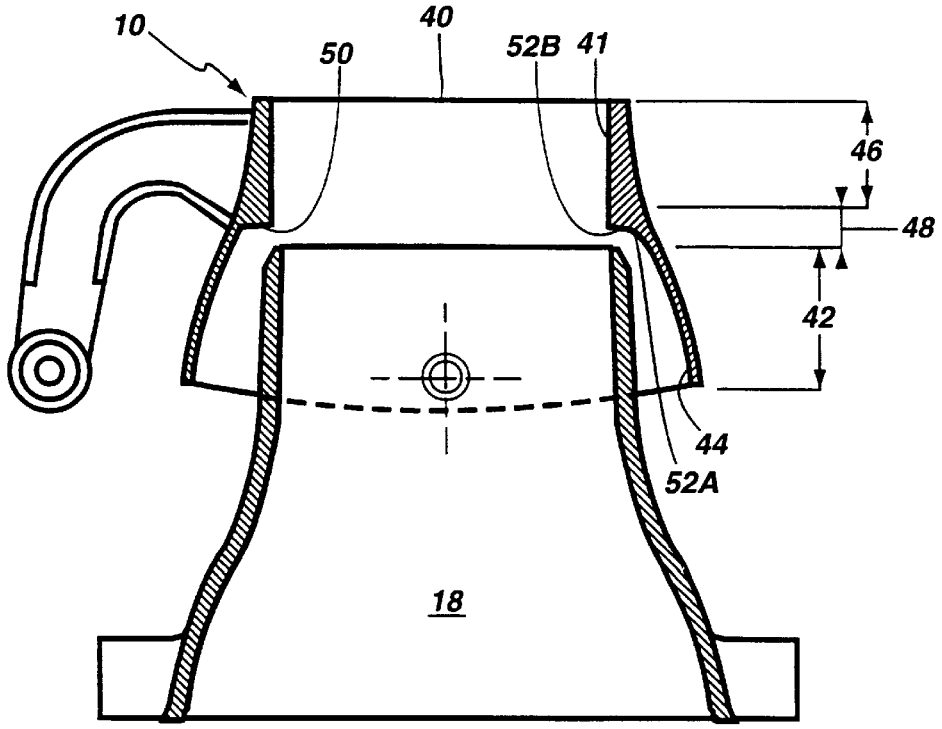
FIG. 4 is a sectional view of a turning-aid nozzle constructed in accordance with a first variant, the nozzle being illustrated mounted on a venturi-orifice.
Figure 5:
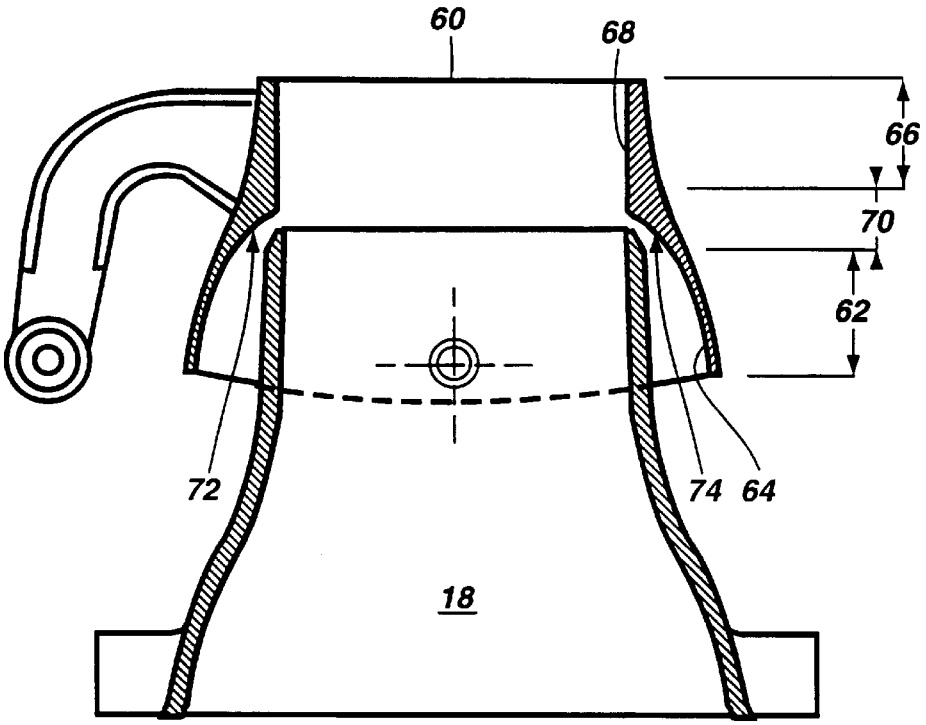
FIG. 5 is a sectional view of a turning-aid nozzle constructed in accordance with a second variant, the nozzle being illustrated mounted on a venturi-orifice.

Referring to FIGS. 3, 4 and 5, it is possible to substantially reduce the force needed to turn the nozzle of a watercraft producing a significant amount of thrust by providing a restrictive projecting surface onto which the water jet exerts a force. By providing an inner surface protruding from the inside wall of the nozzle, during a turn, the water jet impinges on the surface creating a turning moment on the nozzle which aids the rotation of the nozzle with respect to the venturi-orifice.

FIG. 3 illustrates a nozzle constructed in accordance with the present invention comprehensively designated by the reference numeral 10. The nozzle 10 comprises a first portion 12 having an inside wall 14 which defines a substantially bell-shaped passage which is, from a fluid dynamic standpoint, an optimal shape for nozzles. The first portion 12 of the nozzle 10 is mounted at a nozzle pivot 16 near the outlet of a watercraft propulsion system, which, as shown in FIGS. 2, 3, and 4, is typically a venturi-orifice 18. The nozzle 10 has a second portion 20 having an inside wall 22 which defines a cylindrical passage. Between portions 12 and 20, the nozzle 10 has a transitional portion 24 comprising a starboard inner surface 26 and a port inner surface 28. Both the starboard and port inner surfaces protrude radially inwardly from the inside of the nozzle. The starboard and port inner surfaces are preferably moulded or cast integrally with the nozzle during manufacture, although it is also possible to bond or fasten an insert into an existing nozzle to produce the desired inner shape.

As illustrated in FIG. 3, the nozzle 10 is mounted on the venturi-orifice 18 so that the outlet end 30 is adjacent the transitional portion 24. Each of the inner surfaces 26 and 28 defines a wall which at least partially obstructs the water jet so that when the water jet impinges on one of the inner surfaces, the water jet exerts a moment on the nozzle large enough to turn the nozzle. The turning moment produced by the inner surfaces is proportional to the projected surface area of the inner surface that is perpendicular to the water jet and the momentum of the water jet impinging on the inner surface. In other words, when the inner surfaces are perpendicular to the direction of flow of the water jet, the degree of obstruction is largest. However, even if the inner surfaces are at an oblique angle to the direction of flow of the water jet, there is still a component of the surfaces that is normal (i.e. perpendicular) to the direction of flow of the water jet.

Figure 6:
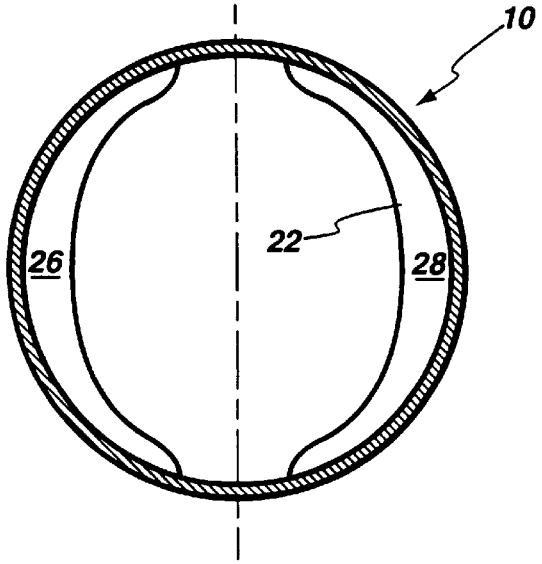
FIG. 6 is a front elevational view of the turning-aid nozzle, illustrating the C-shaped starboard inner surface and the inverted C-shaped port inner surface.

The width of the inner surfaces 26 and 28 is greater adjacent the central axis halfway between the top of the nozzle and the bottom of the nozzle thus defining a starboard inner surface 26 having substantially a C-shape and a port inner surface 28 having substantially an inverted C-shape (as illustrated in FIG. 6).

The nozzle 10 also comprises a steering linkage, such as a push-pull cable or rod, connected at one end to a standard steering mechanism (not shown), the steering mechanism being controllable by a steering wheel, helm, handlebars or any such marine control device. The steering linkage is connected to the nozzle such that a force exerted on the steering linkage causes the nozzle to rotate about the nozzle pivot 16, thereby directing the water jet either to starboard or port. The steering linkage is normally connected to the nozzle via a lever 32, as illustrated in FIGS. 2–5.

FIG. 4 illustrates a nozzle 40 constructed in accordance with a first variant. This nozzle 40 comprises a first portion 42 having an inside wall 44 which defines a substantially bell-shaped passage. The nozzle 40 has a second portion 46 having an inside wall 41 which defines a cylindrical passage. Between portions 42 and 46, the nozzle 40 has a transitional portion 48 comprising a starboard inner surface 50 and a port inner surface 52. The port projection 52 has a wall section 52A which is frusta-conical and a section 52B which, when the nozzle is in its neutral position (i.e. when it is neither turned to starboard or port), is substantially perpendicular to the water jet.

The starboard inner surface 50 defines a wall-like projection which is at least partially perpendicular to the water jet. The inner surface 50 is substantially C-shaped. In this variant, the turning moment that can be produced by the port inner surface 52 is smaller than that produced by the starboard inner surface 50 because the port inner surface 52 obstructs the flow of the water jet less than its starboard counterpart. Because of the direction of rotation of the watercraft's pump, it is easier to steer the watercraft to starboard. In other words, the watercraft has a propensity to pull to starboard due to the angular momentum of the pump. When turning to starboard, the port inner surface need not provide as much turning aid as does the starboard inner surface when turning to port. Thus, it may be desirable to provide the nozzle 40 with a port inner surface 52 which obstructs the water jet less than the starboard inner surface 50.

FIG. 5 illustrates a nozzle 60 constructed in accordance with a second variant. This nozzle 60 comprises a first portion 62 having an inside wall 64 which defines a substantially uniform bell-shaped passage. The nozzle 60 has a second portion 66 having an inside wall 68 which defines a cylindrical passage. Between portions 62 and 66, the nozzle 60 has a transitional portion 70 comprising a starboard inner surface 72 and a port inner surface 74, such inner surfaces 72 and 74 being preferably integrally formed with the inside wall 64 for providing a smoother tapered transitional portion. Each inner surface 72 and 74 defines a tapered wall-like section, the angle of taper being more accentuated for the starboard inner surface 72. Thus, the turning moment created by the starboard inner surface 72 is larger than that created by the port inner surface 74 because the starboard inner surface 72 produces a greater flow obstruction. As indicated earlier, it may be desirable to provide a nozzle wherein the port inner surface 74 obstructs the water jet less than the starboard inner surface 72 to compensate for the pump rotation.

It is understood that the projections can define different forms and have different widths in order to create different momentum intensities.

The above description of the preferred embodiment should not be interpreted in any limiting manner since variations and refinements are possible which are within the spirit and scope of the present invention. The scope of the invention is defined in the appended claims.

What is claimed is:

1. A turning-aid nozzle mounted in the region of the outlet of a watercraft propulsion system, said nozzle being moveable to any orientation between an extreme starboard orientation and an extreme port orientation, said nozzle being capable of directing the water jet egressing said propulsion system in order to steer said watercraft, said nozzle comprising:

(A) a steering linkage connected at one end to a steering mechanism, said steering linkage being connected at the other end to said nozzle such that a force exerted on the steering linkage causes the nozzle to rotate, thereby directing the water jet either to starboard or port;

(B) a starboard inner surface protruding radially inwardly from the inner wall of said nozzle such that during a turn to port the water jet egressing from the watercraft propulsion system impinges on said starboard inner surface, thereby creating an additional turning moment to port; and (C) a port inner surface protruding radially inwardly from the inner wall of said nozzle such that during a turn to starboard the water jet egressing from the watercraft propulsion system impinges on said port inner surface, thereby creating an additional turning moment to starboard;

whereby, when the nozzle is aligned parallel to the water jet egressing from the propulsion system, an insubstantial amount of water impinges upon said starboard and port inner surfaces.

2. A turning-aid nozzle as defined in claim 1 wherein said starboard inner surface and said port inner surface are substantially symmetrical.

3. A turning-aid nozzle as defined in claim 1 wherein said starboard inner surface and said port inner surface are asymmetrical.

4. A turning-aid nozzle as defined in claim 1, further comprising:

(A) a first portion having a substantially bell-shaped profile of decreasing cross-sectional area in the direction of flow of the water jet;

(B) a transitional portion whereat said starboard inner surface and said port inner surface protrude inwardly from said nozzle; and (C) a second portion, aft of said transitional portion, having a substantially annular profile of constant cross-sectional area.

5. A turning-aid nozzle as defined in claim 4 wherein said starboard inner surface and said port inner surface are substantially symmetrical.

6. A turning-aid nozzle as defined in claim 4 wherein said starboard inner surface and said port inner surface are asymmetrical.

7. A turning-aid nozzle as defined in claim 6 wherein said starboard inner surface is capable of producing a greater turning moment than said port inner surface in order to compensate for the direction of rotation of the watercraft's pump.

8. A turning-aid nozzle as defined in claim 6 wherein said port inner surface is capable of producing a greater moment than said starboard inner surface in order to compensate for the direction of rotation of the watercraft's pump.

9. A turning-aid nozzle as defined in claim 1 wherein said starboard inner surface and said port inner surface are substantially C-shaped.

10. A turning-aid nozzle as defined in claim 4 wherein said starboard inner surface and said port inner surface are substantially C-shaped.

11. A turning-aid nozzle as defined in claim 6 wherein said starboard inner surface and said port inner surface are substantially C-shaped.

12. A turning-aid nozzle as defined in claim 7 wherein said starboard inner surface and said port inner surface are substantially C-shaped.

13. A watercraft comprising a turning-aid nozzle mounted in the region of the outlet of a watercraft propulsion system, said nozzle being moveable to any orientation between an extreme starboard orientation and an extreme port orientation, said nozzle being capable of directing the water jet egressing said propulsion system in order to steer said watercraft, said nozzle comprising:

(A) a steering linkage connected at one end to a steering mechanism, said steering linkage being connected at the other end to said nozzle such that a force exerted on the steering linkage causes the nozzle to rotate, thereby directing the water jet either to starboard or port;

(B) a starboard inner surface protruding radially inwardly from the inner wall of said nozzle such that during a turn to port the water jet egressing from the watercraft propulsion system impinges on said starboard inner surface, thereby creating an additional turning moment to port; and (C) a port inner surface protruding radially inwardly from the inner wall of said nozzle such that during a turn to starboard the water jet egressing from the watercraft propulsion system impinges on said port inner surface, thereby creating an additional turning moment to starboard;

whereby, when the nozzle is aligned parallel to the water jet egressing from the propulsion system, an insubstantial amount of water impinges upon said starboard and port inner surfaces.

14. A watercraft as defined in claim 13 wherein said starboard inner surface and said port inner surface are substantially symmetrical.

15. A watercraft as defined in claim 13 wherein said starboard inner surface and said port inner surface are asymmetrical.

16. A watercraft as defined in claim 13 wherein said starboard inner surface and said port inner surface are substantially C-shaped.

* * * * *